US007475437B2

(12) United States Patent
Herrera-Gurrola

(10) Patent No.: US 7,475,437 B2
(45) Date of Patent: Jan. 13, 2009

(54) DEVICE TO RAISE AND LOWER A TOILET SEAT

(76) Inventor: David Herrera-Gurrola, Paseo de Sta. Roas No. 13, La Asuncion, Metepec, Estado de Mexico C.P. (MX) 52174

( * ) Notice: Subject to any disclaimer, the term of this patent is extended or adjusted under 35 U.S.C. 154(b) by 365 days.

(21) Appl. No.: 11/246,562

(22) Filed: Oct. 11, 2005

(65) Prior Publication Data

US 2007/0079430 A1 Apr. 12, 2007

(51) Int. Cl.
*A47K 13/10* (2006.01)

(52) U.S. Cl. ..... 4/246.3

(58) Field of Classification Search ..... 4/246.1–246.5
See application file for complete search history.

(56) References Cited

U.S. PATENT DOCUMENTS 2,011,404 A * 8/1935 Giliasso ..... 4/246.4
2,295,167 A 9/1942 Groote et al.
3,504,385 A 4/1970 Fields
4,578,830 A * 4/1986 Chuang ..... 4/246.3
5,404,595 A * 4/1995 Carmel ..... 4/246.1
5,713,084 A 2/1998 Greco
5,896,592 A 4/1999 Cruz et al.
6,112,335 A 9/2000 Gaston
6,226,804 B1 5/2001 Ballard
6,321,293 B1 11/2001 Fabrizio et al.
6,393,623 B1 * 5/2002 Strickland, Jr. ..... 4/246.3
6,588,027 B1 7/2003 Bowden et al.
6,615,412 B1 9/2003 Hammond

* cited by examiner

*Primary Examiner*—Charles E Phillips
(74) *Attorney, Agent, or Firm*—Browdy and Neimark, P.L.L.C.

(57) ABSTRACT

A device is depicted to raise and lower a toilet seat, the device having a rotation axis located under the toilet seat and which is attached or comes into contact with it; a lever attached to the rotation axis and which is moved by a user in order to convey its motion towards the rotation axis which, by being attached to the seat or coming in contact to it, raises or lowers the seat as desired; the rotation axis is housed in the conduits of already existing hinges that are formed by the toilet cover, seat, and hinge supports, or the rotation axis is housed along a housing provided in a base plate that is attached to the hinge supports existing in any toilet seats.

9 Claims, 8 Drawing Sheets

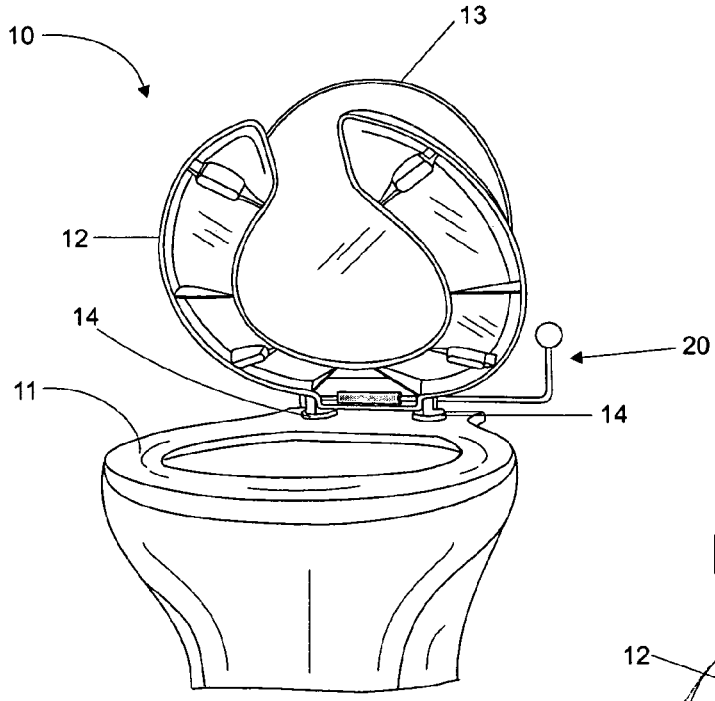
FIG. 1
FIG. 2A
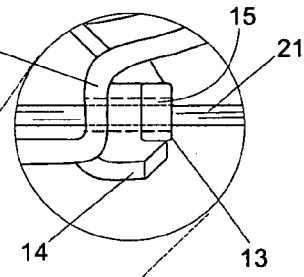
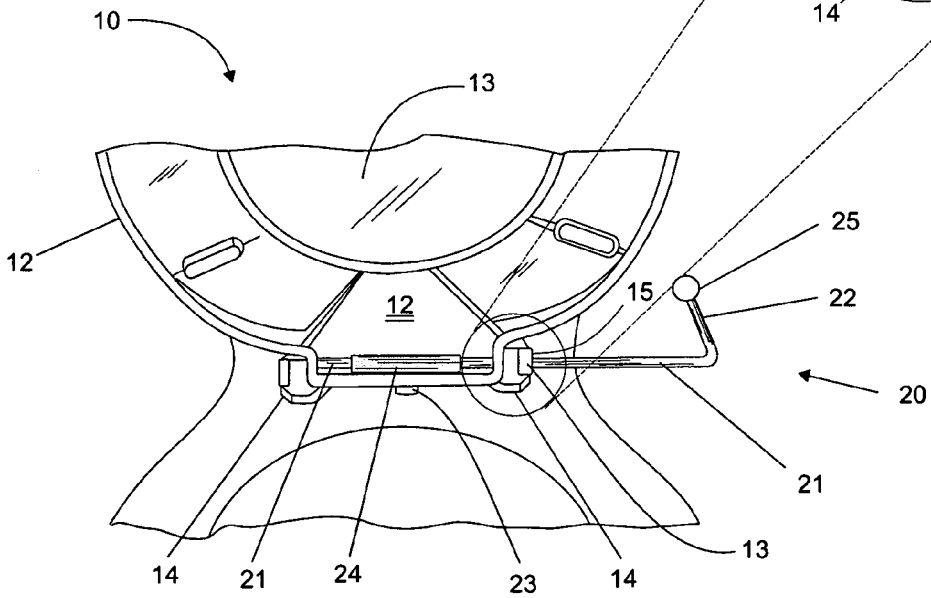
FIG. 2

SECTION A-A′

DEVICE TO RAISE AND LOWER A TOILET SEAT

FIELD OF THE INVENTION

The present invention relates to the techniques used in designing and manufacturing toilets and, more particularly, to a device to raise and lower toilet seats.

BACKGROUND OF THE INVENTION

When someone wishes to use a toilet in public locations such as restaurants, theaters, concert halls, etcetera, it is a common situation that the toilet seat and cover are soiled with liquids or substances of varying nature, such that when raising the cover and seat hands come into contact with the soiled surface. This contact may result in biologic-infectious illnesses, in addition to bothering the one aiming to use the toilet. Thus, users often prefer not to use public toilets.

Likewise, sometimes seats are so soiled that users need or prefer to raise the seat in advance, along with the cover, in order to prevent their legs from coming in contact with the seat surface. However, this action does not prevent their hands from being directly in contact with the soiled seat, thereby resulting in the abovementioned risks and discomfort, which may even take place in domestic toilets.

It is worth mentioning that, even if most toilets seats are raised beyond the upper border of the toilet upper surface or rim by a height of about 5 to 8 millimeters in order to prevent liquids from building up between the seat and the rim, the seat continues to be wetted to some extent. Likewise, there are seats having their lower wall in a flat or concave shape. In this case, the seat includes radial ribs which raise it beyond the rim. However, this soiling problem is not fully avoided either.

On the other hand, there are also times where someone suffering from back problems finds almost impossible to lean down and raise a toilet cover and/or seat, needing help from other person to perform this seemingly easy task.

In order to face and solve these problems, there are some devices in the art to raise a toilet seat with no need to touch it or lean down. For example, the U.S. U.S. Pat. No. 3,504,385; U.S. Pat. No. 5,713,084; U.S. Pat. No. 6,112,335; U.S. Pat. No. 6,588,027; and U.S. Pat. No. 6,615,412 depict devices that are driven through the user foot, allowing to raise cover and thus the seat of a toilet. Generally, these devices are already installed either on the toilet or on the ground. However, they require considerable room, which is not available in many toilets. Also, the installation of such devices is difficult, due to the numerous parts and systems integrating them, which may be extremely complex and thus expensive. Likewise, due to the cleaning works that must be performed in toilets, this kind of devices may be damaged by water.

On the other hand, there are devices that are not directly driven by the user, but which use much more complex systems, such as the device depicted in the U.S. Pat. No. 6,321,293. Such a device has an optical and electronic system which is activated when the user comes close to the toilet, such that the device automatically raises the seat through very complex motors and components. Likewise, the device depicted in U.S. Pat. No. 6,226,804 raises the seat through a motor when the user activates the device by pressing a button. Although comfortable, these systems are very expensive and, as they require a lot of materials and equipment, they are also difficult to install.

In the prior art there are also simple devices, such as the one depicted in the U.S. Pat. No. 5,896,592, which comprises a plate, a lever, and a counterweight which automatically keep the seat raised when it is not in use. However, although this device exhibits a simple construction, it has the disadvantage of not providing the option of having the seat in another position, since it is always kept raised.

Another simple device may be found in the British Patent Application 2,295,167 A, wherein the device comprises two independent levers to respectively raise either the toilet seat or cover. These levers may be driven by means of hydraulic, pneumatic, or electrical means. However, it is completely clear that it is necessary to perform major adjustments to the seat or cover to secure such levers, such adjustments being even more important when the levers are driven by means of the abovementioned motion means.

Accordingly, it is easy to appreciate that the design and installation of the devices existing in the art are generally not involved in the basic assembly existing between the essential parts of toilets, i.e. for the installation of the devices in the prior art some substantial changes are to be made, either to the toilet, cover, seat, or even to the space surrounding the toilet.

Regarding the above, it is worth mentioning that toilet seats and covers are integrated in one assembly that is mounted on a pair of mounting bores located in the rear part of the toilet upper surface or rim. However, it is worth mentioning that many public toilets have only one seat mounted.

Also, the seat and cover have a common joint or hinge allowing to raise and lower the seat and/or cover beyond the toilet rim. More particularly, such a joint is formed by a pair of hinge supports which are just the ones that are secured on the rim mounting bores. Such hinge supports include holes that concentrically line up with other holes included both in the seat and cover such that, upon lining up, they form a conduit to receive the bolts or pins, thereby forming the hinge on which a movement is performed to raise and lower the seat and/or cover. In the prior art there is no device related in a simple manner to this basic arrangement between the toilet seat, cover, and rim and the hinge supports.

SUMMARY OF THE INVENTION

Considering the disadvantages of the prior art, one object of the present invention is providing a device to raise and lower a toilet seat having a simple and practical construction, but effective enough to prevent users from touching the seat with their hands.

Another object of the present invention is providing a device to raise and lower a toilet seat which is not too voluminous in order for the device already installed in the toilet not to hinder the users, but be easily operated.

An additional object of the present invention is providing a device to raise and lower a toilet seat that is easily installed in most toilets, covers, and seats currently available in the market.

To overcome the problems of the prior art, a device has been developed to raise and lower a toilet seat. The device is suitable for the general arrangement of toilets in which the seat is mounted as a hinge on the toilet by means of hinge supports that are secured to the toilet rim through securing means that are inserted in mounting holes included on the rim rear part. The toilet may optionally include a cover for the seat. The cover, seat, and every hinge support are provided with holes that line up to form conduits for hinge bolts.

For this basic arrangement, the device of the present invention comprises a rotation axis securely attached to the seat and placed under its lower wall, the rotation axis being located between the hinge supports and received in such conduits for hinge bolts in order to freely be housed inside them, such that the rotation axis acts as a hinge arm for the seat and cover.

Likewise, the device of the present invention also comprises a lever attached to one of the rotation axis ends to make it rotate.

With this main elements, when the seat and cover are covering the toilet rim and a user rotates the lever to the back of the toilet from an initial position, such a lever moves such rotation axis inside the conduits for hinge bolts. Such a rotation axis, by being securely attached to the seat, makes it raise up to a vertical position, along with the cover. Then, when moving such a lever to the front of the toilet to take it to its initial position, the lever moves such a rotation axis, which lowers the seat to place it again on the toilet rim.

The advantage of the device is its simplicity and the fact that it is also installed on the basic arrangement by means of which the seat and, if it is the case, the cover are mounted as a hinge on toilets.

In a preferred embodiment, the device includes a casing covering the portion of the rotation axis that is located under the seat, such casing improving the joint between the seat and the rotation axis.

In an alternative embodiment of the present invention, the rotation axis is not securely attached to the toilet seat, but in contact with the lower and upper walls of the seat and, particularly, the rotation axis has an upwards driving branch and a downwards driving branch, from which the upwards driving branch runs from the rotation axis to the lower wall of the seat to come into contact with it, while the downwards driving branch runs from the rotation axis to the upper wall of the seat to come into contact with it. Of course, this alternative embodiment of the invention comprises a lever attached to one of the rotation axis ends to make it rotate and, as an additional element, the device comprises a base plate that is securely mounted between the hinge supports and the rim by means of the same securing means as the ones used to mount the seat to the rim. The base plate includes a housing where the rotation axis is freely housed to rotate inside it. The housing is located under the seat, such that it is hidden when the seat is on the rim.

In this alternative embodiment, when the seat and the cover are on the toilet rim and a user rotates the lever to the back of the toilet from an initial position, the upwards driving branch being in contact with the toilet lower wall raises the seat, along with the cover, to a vertical position rotating on the hinge bolt. Later, when moving the lever to the front of the toilet in order to bring it to its initial position, such a lever moves the rotation axis, whose downwards driving branch being in contact with the seat upper wall lowers the seat and places it on the toilet rim.

The advantage of these alternative embodiments is that the device may be easily installed between the seat hinge supports and the toilet rim with no changes or modifications performed on the hinge supports or cover.

BRIEF DESCRIPTION OF THE DRAWINGS

The innovative aspects considered to characterize the present invention will be established with more detail in the appended claims. However, due both to its organization and operation method, the invention itself, along with other objects and advantages of the same, will be better understood by reading the following detailed description of certain embodiments in connection to the appended drawings, where:

FIG. 1 is a front and top perspective view of a toilet having a device to raise and lower the toilet seat, the device being constructed according to a preferred embodiment of the present invention.

FIG. 2 is a partial and widened view around the mounting area of the seat on the toilet shown in FIG. 1, wherein the cover and seat are raised on the toilet.

FIG. 2A is a widened view around the hinge area formed between the seat, cover, and hinge support in the toilet shown in FIG. 2.

DETAILED DESCRIPTION OF THE INVENTION

Figure 3:
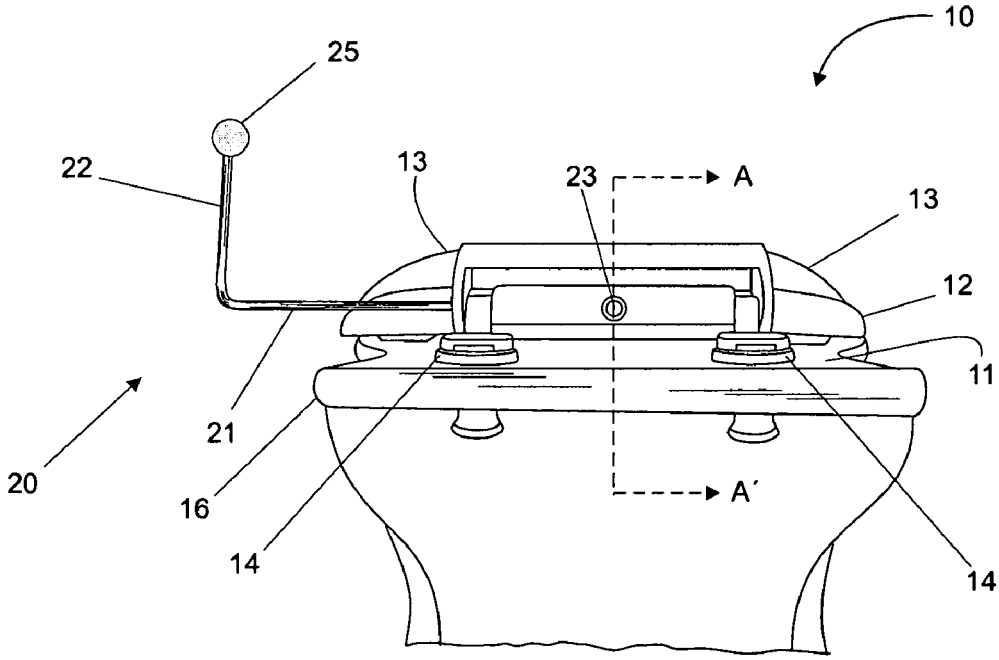
FIG. 3 is a rear view of the toilet shown in FIG. 1, wherein the toilet cover and seat are covering the toilet rim.

Particularly with respect to the appended drawings and more specifically to FIG. 1, a toilet 10 is shown having an upper surface or rim 11; a seat 12 mounted as a hinge in the rear part of rim 11 by means of a pair of hinge supports 14 which are attached to the rim 11 through securing means such as screws or bolts that are inserted into mounting holes provided in the rear part of rim 11. The toilet 10 includes a cover 13 located over the seat 12 and associated to it to cover the rim 11. In FIG. 1, a device 20 to raise and lower the seat 12 of toilet 10 is shown. The device 20 is constructed according to a preferred embodiment of the present invention that must be considered as illustrative and non-limitative of the same.

Referring to FIGS. 2 and 2A, the toilet 10, seat 12, cover 13, and hinge supports 14 are shown including holes that are concentrically lined up such that they form spaces or conduits 15 for hinge bolts (FIG. 2A), wherein a part of the device 20 is housed and which, in this preferred embodiment, comprises: a rotation axis 21 securely attached to the seat 12 and located under its lower wall, the rotation axis 21 running between the hinge supports 14 and being received in such conduits 15 in order to be freely housed inside them, such that the rotation axis 21 acts as a hinge arm for the seat 12 and cover 13. The device 20 also comprises a lever 22 attached to one end of the rotation axis 21 and having the function to make it rotate.

Regarding the above, the rotation axis 21 is securely attached to the seat 12 through attachment means inserted through the seat until reaching and be attached to such rotation axis 21, such attachment means being screws, bolts, coach screws, pins, or rivets. For example, in the preferred embodiment of the present invention, a screw 23 is used to be inserted through the rear wall of seat 12 in order to be housed inside the rotation axis 21, being the screw 23 hidden from the user sight.

In the preferred embodiment of the present invention, the preferred arrangement of the securing means, such as the screw 23, does not imply a restriction, since such means may be inserted into other parts of the seat 12, such as its upper wall, provided that the rotation axis 21 is securely attached to the seat 12. Likewise, glues, adhesives, couplings, etcetera may be used to performed the required attachment between the rotation axis 21 and the seat 12.

Furthermore, FIG. 2 shows that the lever 22 includes a handle 25 on its free end to allow a user to activate the device 20. Likewise, FIG. 2 shows a housing 24 located around the portion of the rotation axis 21 placed between hinge supports 14, such housing 24 having the function to achieve a securest and tightest attachment between the seat 12 and the rotation axis 21, the screw 23 passing preferably through such a housing.

Figure 4:
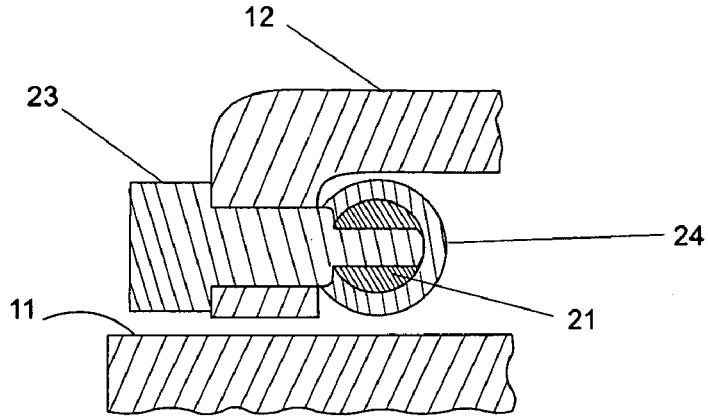
FIG. 4 is a partial view of a cross-section cutout taken along line A-A' of the toilet shown in FIG. 3.

Referring to FIG. 3, which shows a rear view of the toilet 10, with its rim 11, seat 12, cover 13, and hinge supports 14, it can be seen more clearly how the screw 23 is inserted through the rear wall of seat 12. Now, with the aid of FIG. 4, which shows a cross-section cutout along line A-A' of FIG. 3, it may be seen how the screw 23 passes through the rear wall of seat 12, as well as the housing 24, and is inserted inside the rotation axis 21. The housing 24 is preferably a body having cylindrical shape that is made of plastic, rubber, stainless metals, etcetera. FIG. 4 shows a portion of the rim 11 to provide a better understanding of the location of the seat 12 and screw 23.

Referring again to FIG. 3, it can be said that the length of the rotation axis 21 is such that one of its ends is level with one of the hinge supports 14 while the other end, to which the lever 22 is attached, extends beyond the vertical plane of the outer side edge 16 of rim 11 of toilet 10. The rotation axis 21 has a length of about 10 to about 45 centimeters, this length being enough for the device 20 to be installed and driven in most seats of commercially available toilets. More preferably, the rotation axis 21 has a length of about 30 to about 40 centimeters.

With respect to lever 22, in the preferred embodiment of the present invention, it is fully attached to the rotation axis 21 in a perpendicular relationship such that they jointly have the shape of an "L ". Once again, it will be apparent that this arrangement of the lever 22 is preferable, since it may be attached to the rotation axis 21 in a slightly angled relationship with respect to the perpendicular. The lever 22 has preferably a length from about 10 to about 40 centimeters, this length allowing the user to immediately locate the device 20 to be taken by means of handle 25. More preferably, the lever 22 has a length of about 10 to about 20 centimeters.

Figure 5C:
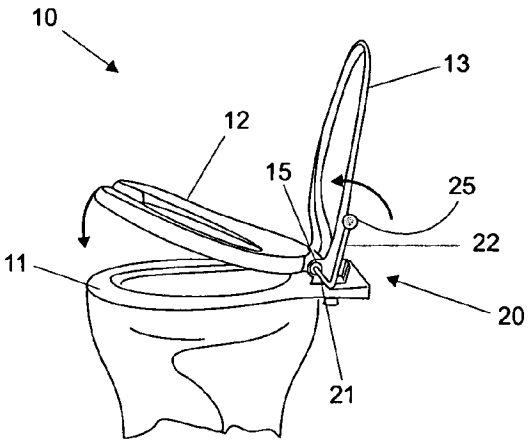
FIGS. 5A, 5B, and 5C are lateral perspective views of the toilet shown in FIG. 1, wherein the device movement sequence to raise and lower the toilet seat is shown.
Figure 5B:
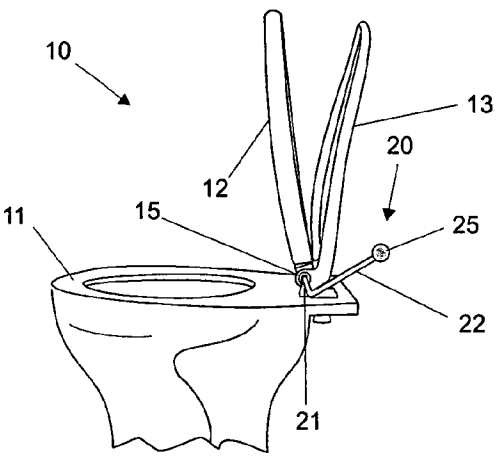
Figure 5A:
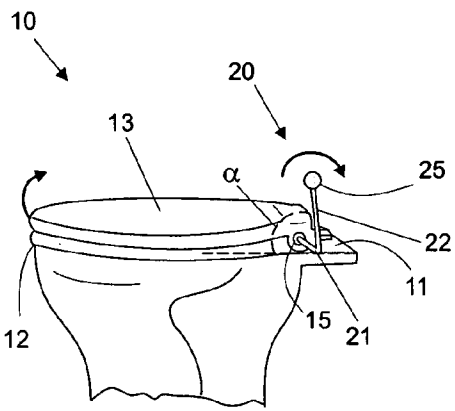

Referring now to FIG. 5A in order to depict a preferred feature of the lever 22 which, when laterally seen in the toilet 10 with the seat 12 located on the rim 11, is placed at an angle $\alpha$ taking values from about 10° to about 180° with respect to the horizontal plane of rim 11. Although other angles are also possible, the abovementioned range allows the user to have an extremely easy access to the device 20 from the front part of the toilet 10 and not to be hindered when seated on it. The lever 22 is preferably at an angle $\alpha$ of about 90° to about 110° with respect to rim 11.

Regarding the materials of which the lever 22 and rotation axis 21 are made, they are preferably made of stainless metals, such as stainless steel, chromed iron, nickel-plated iron, or aluminum, or they are made of plastic materials such as polypropylene, polyester, polystyrene, polycarbonate, PVC, nylon, and polymethylmethacrylate. Such parts of the device 20 are more preferably made of stainless steel. On the other hand, the handle 25 having a spherical shape and included in the lever 22 is made of rubber, plastic materials, wood, stainless steel, or aluminum.

Referring now jointly to FIGS. 5A to 5C in order to explain how the device 20 acts, in particular, when the seat 12 and cover 13 are covering the rim 11 of toilet 10 (FIG. 5A) and a user rotates the lever 22 to the back of the toilet 10 from an initial position, such lever 22 moves the rotation axis 21 inside the conduits 15 for hinge bolts. By being securely attached to the seat 12, the rotation axis 21 raises it to a vertical position, along with the cover 13 (FIG. 5B). Afterwards, when moving the lever 22 to the front of toilet 10 to bring it to its initial position, the lever 22 moves the rotation axis 21, which lowers the seat 12 to be located on the rim 11 of toilet 10 (see FIG. 5C). The device 20 prevents the user from touching the seat 12, since only the handle 25 needs to be manipulated.

On the other hand, the device of the present invention may be installed on a location other than the one depicted for the preferred embodiment of FIGS. 1 to 5C.

To explain the above, reference is made now to FIGS. 6 to 13C, which show the device of the present invention constructed according to one alternative embodiment of the same.

Figure 6:
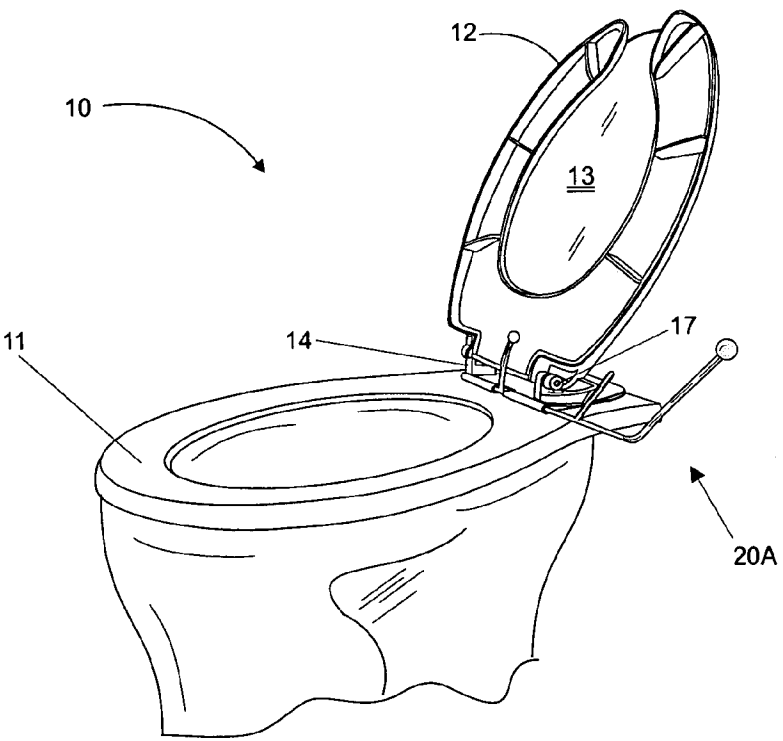
FIG. 6 is a lateral and top perspective view of a toilet where the device to raise and lower the toilet seat is installed, the device being constructed according to an alternative embodiment of the present invention.

Particularly, FIGS. 6 and 7 show again a toilet 10 having a rim 11, a seat 12 mounted as a hinge on the rear part of the rim 11 through a pair of hinge supports 14 that are attached to the rim through securing means, such as the screws 18 that are inserted into the mounting holes 19 provided in the rear part of the rim 11. The toilet 10 includes a cover 13 located over the seat 12 and associated to it to cover the rim 11. The hinge supports 14, cover 13, and seat 12 are provided with holes lined up such that they form conduits or spaces where a hinge bolt 17 is inserted. Likewise, FIGS. 6 and 7 show the device 20A of the alternative embodiment of the invention to raise and lower the seat 12 of toilet 10.

Figure 7:
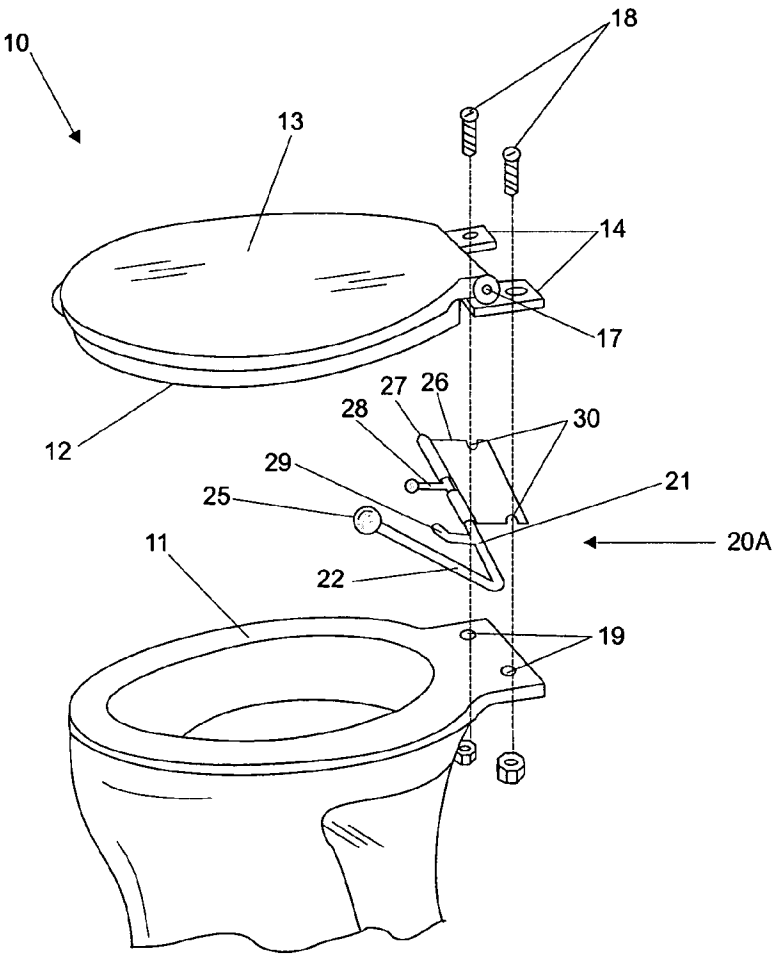
FIG. 7 is an exploded view of the toilet shown in FIG. 6.
Figure 9:
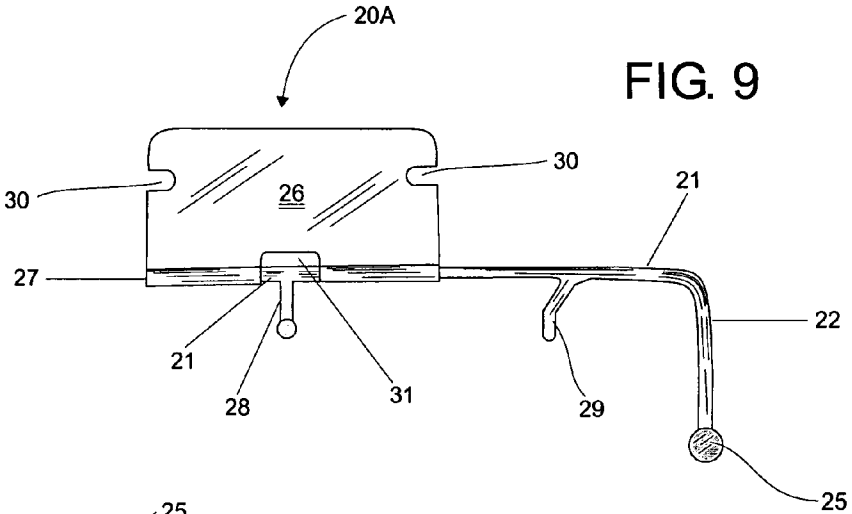
FIG. 9 is a top plan view of the device to raise and lower the toilet seat shown in FIG. 6, the device being constructed according to the alternative embodiment of the present invention.
Figure 8:
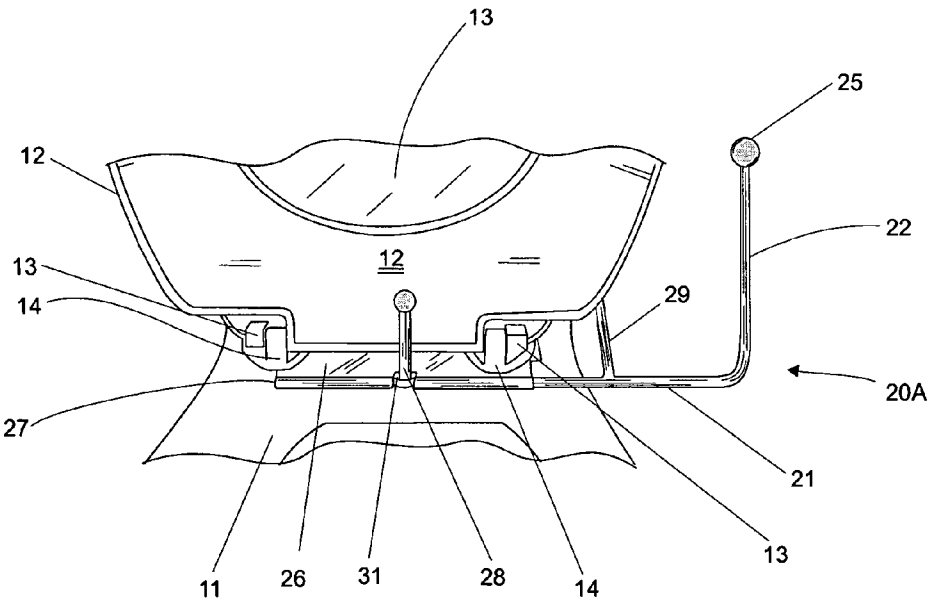
FIG. 8 is a partial and widened view around the seat mounting area on the toilet shown in FIG. 6, wherein the cover and seat are raised on the toilet.

In order to depict with more detail this alternative embodiment, reference is jointly made to FIGS. 7, 8, and 9, which show that the device 20A comprises a rotation axis 21 having an upwards driving branch 28 and a downwards driving branch 29 from which the upwards driving branch 28 runs from the rotation axis 21 to the lower wall of seat 12 to come into contact with it, while the downwards driving branch 29 runs from the rotation axis 21 to the upper wall of seat 12 to come into contact to it. Furthermore, it is seen again that the device 20A of this alternative embodiment has a lever 22 attached to one end of the rotation axis 21 to make it rotate. And, as an additional element, the device 20A comprises a base plate 26 that is securely mounted between the hinge supports 14 and the rim 11 through securing means, in this case the screws 18, as mentioned before, the hinge supports being used to mount the seat 12 and cover 13. The base plate 26 includes a housing 27 where the rotation axis 21 is freely housed to rotate within the same. The housing 27 is located between the hinge supports 14 such that it is hidden by the seat 12 when the latter covers the rim 11. FIGS. 7, 8, and 9 show that the lever 22 includes a handle 25 having a spherical shape on its free end to allow a user to activate the device 20A.

Referring in particular to FIG. 9, it shows more clearly the device 20A of the alternative embodiment of the invention. From this figure it may be said with respect to the base plate 26 that it has an opening 31 through which the upwards driving branch 28 runs from the rotation axis 21 towards the lower wall of seat 12, as can also be appreciated in FIG. 8.

Referring again to FIG. 9, it show that the base plate 26 includes notches 30 to allow the base plate 26 to be mounted between the hinge supports 14 and rim 11 of toilet 10 through the screws 18, as shown in the exploded view of FIG. 7. The notches 30 are preferably near the lateral sides of the base plate 26, which has preferably a rectangular shape. However, notches 30 may also be holes. The base plate 26 is preferably formed from a sheet that is transversally folded such that such housing 27 is formed on such a fold, where the rotation axis 21 is received.

Figure 9A:
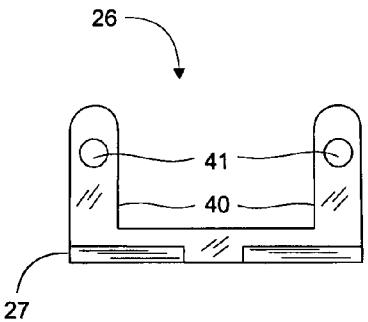
FIG. 9A is a top plan view of a specific embodiment of the base plate for the device of the present invention.

In order to save material in the base plate 26, it may have the shape of a "U " or horseshoe, as shown in FIG. 9A, wherein the horizontal part of such a "U " fully includes the housing 27 or wherein it is attached to the base plate 26 and the sides or arms 40 of such a "U " include the bores 41 which allow the base plate 26 to be mounted between the rim and the hinge supports. In FIG. 9A, the housing 27 is attached to the base plate 26 using securing means such as screws, bolts, coach screws, pins, rivets, welding, glues, adhesives, or couplings.

Figure 10:
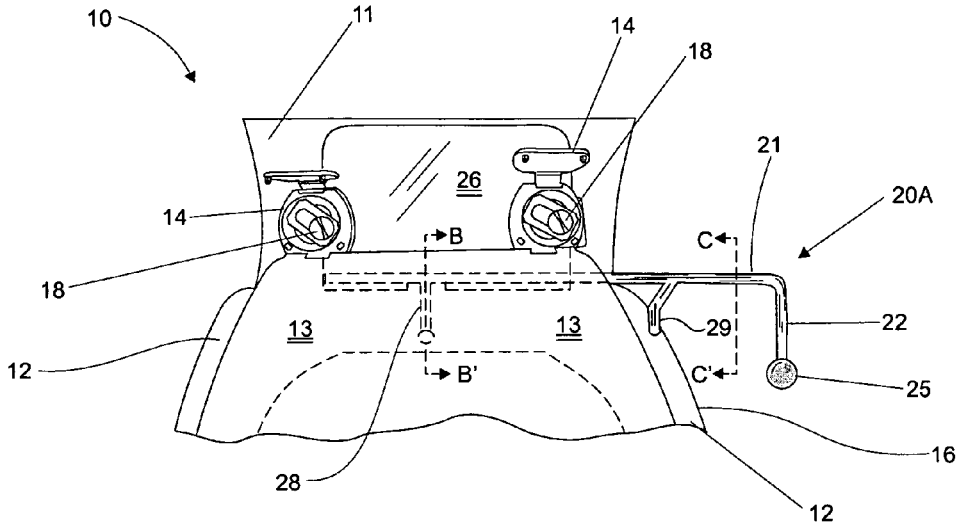
FIG. 10 is a partial top plan view of the toilet shown in FIG. 6, wherein the cover and seat are covering the toilet rim.

Reference is now made to FIG. 10 in order to depict a little bit more the features of device 20A of this alternative embodiment and its action on the seat 12. FIG. 10, which is a top plan view of the toilet 10 with the seat 12 and cover 13 on the rim 11, shows that the length of the rotation axis 21 is such that one of its ends is level with one side edge of the base plate 26 while the other end, to which the plate 22 is attached, extends beyond the vertical plane of the outer side edge 16 of rim 11. The rotation axis 21 preferably has a length from about 10 to about 45 centimeters, this length being enough for the device 20A to be installed and driven in most commercially available toilets. More preferably, the length of the rotation axis 21 is from about 30 to about 40 centimeters.

Still referring to FIG. 10, it shows how the base plate 26 is attached between the hinge supports 14 and the rim 11 of toilet 10 through the screws 18. In FIG. 10, the upwards driving branch 28 is represented using dotted lines, since it is hidden by seat 12, while it is seen that the downwards driving branch 29 comes into contact with the upper wall of seat 12.

Figure 11:
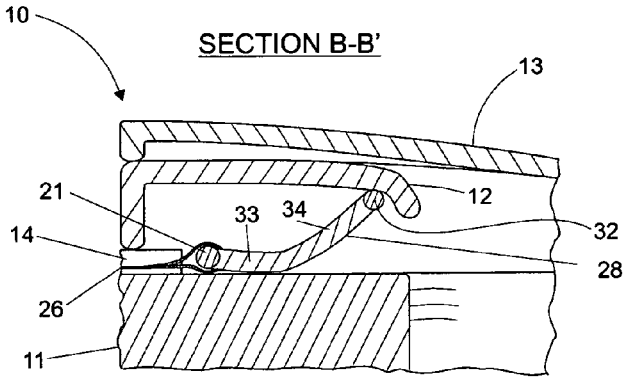
FIG. 11 is a partial view of a cross-section cutout taken along line B-B' in the toilet shown in FIG. 10.

Referring to FIG. 11, which shows a cutout taken along line B-B' of FIG. 10, it is seen that the upwards driving branch 28, when laterally seen in toilet 10 with the seat 12 and cover 13 on the rim 11, has a first section 33 which straightly and horizontally runs from the rotation axis 21, and a second section 34 which runs upwards from the final end of the first section towards the lower wall of seat 12 such that only the tip of the upwards driving branch 28 comes into contact with such lower wall. This preferred path of the upwards driving branch 28 prevents it from interfering with the upwards and downwards movement of seat 12. Likewise, the upwards driving branch 28 preferably has a protective cover 32 located on its end, which reduces the friction with the lower wall of seat 12 every time it is raised or lowered. The protective cover 32 is preferably made of plastic materials. It is worth mentioning that, although the contact between the upwards driving branch 28 with the lower wall of seat 12 seems minimal, such a contact is enough to raise the seat 12 when the device is activated. Other elements that may be seen in FIG. 11 are the abovementioned hinge supports 14, rotation axis 21, and base plate 26.

Figure 12:
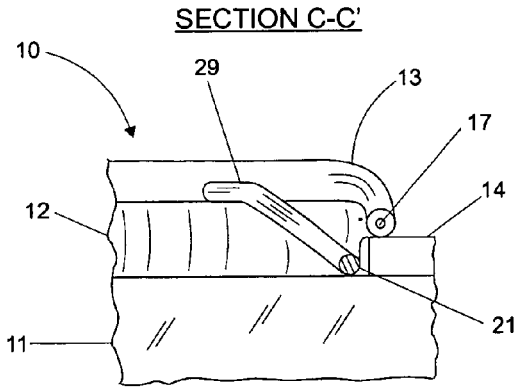
FIG. 12 is a partial view of a cross-section cutout taken along line C-C' in the toilet shown in FIG. 10.

Referring now to FIG. 12 in order to depict the conformation of the downwards driving branch 29 which, when laterally seen in toilet 10 with seat 12 on ream 11 from the rotation axis 21, follows a tilted and straight path upwards and towards the inner part of the seat 12 until reaching a height slightly greater to the height of upper wall of seat 12, where it is slightly tilted such that the end of the downwards driving branch 29 come into contact with such an upper wall. The end of the downwards driving branch 29 has a round shape in order for the 12 not to be damaged or to prevent bothering the user when the seat 12 is used. Although the contact between the downwards driving branch 29 and the upper wall of the seat 12 seems minimal, it is enough to lower the seat 12 quite easily by activating the device. Other elements that may be seen in this figure are the hinge supports 14, as well as the hinge bolt 17 on which the seat 12 and cover 13 rotate.

Referring again to FIG. 10, it is seen that the lever 22 is integrally attached to the rotation axis 21 in a perpendicular relationship such that they jointly form an "L ". Once again, it will be apparent that this arrangement of lever 22 is preferred, since it may be attached to the rotation axis 21 in a slightly angled relationship to the perpendicular. In the alternative embodiment of the invention, the lever 22 has preferably a length from about 10 to about 40 centimeters, more preferably from about 10 to about 20 centimeters.

Figure 13A:
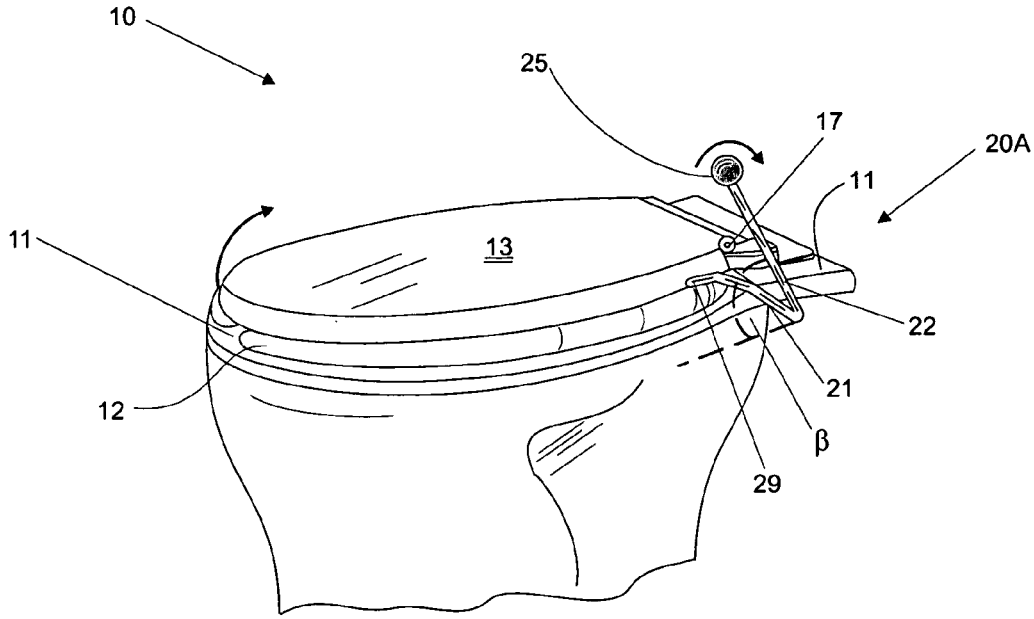
FIGS. 13A to 13C are top and lateral perspective views of the toilet shown in FIG. 6, wherein the device movement sequence to raise and lower the toilet is seen.

In order to describe the arrangement of the lever 22 with respect to the toilet rim 11, reference is made to FIG. 13A. When laterally seen in toilet 10 with the seat 12 located on the rim 11, the lever 22 is located with respect to the horizontal plane of rim 11 at an angle β ranging from about 10° to about 180°. Although other angles are also possible, the abovementioned range allows the user to have an extremely easy access to the device 20A from the front part of toilet 10 and not to be hindered by it when seated on the toilet. More preferably, the lever 22 is located at an angle β from about 90° to about 110° with respect to the rim 11.

It should be understood that, in the alternative embodiment, the lever 22 and the rotation axis 21 are preferably made of stainless metal materials, such as stainless steel, chromed iron, nickel-plated iron, or aluminum, or they are made of plastic materials such as polypropylene, polyester, polystyrene, polycarbonate, PVC; nylon, polymethylmethacrylate, such parts of the device more preferably being made of stainless steel. On the other hand, the handle 25 having a spherical shape conforming to the lever 22 is made of rubber, plastic materials, wood, stainless steel, aluminum, etcetera.

Figure 13B:
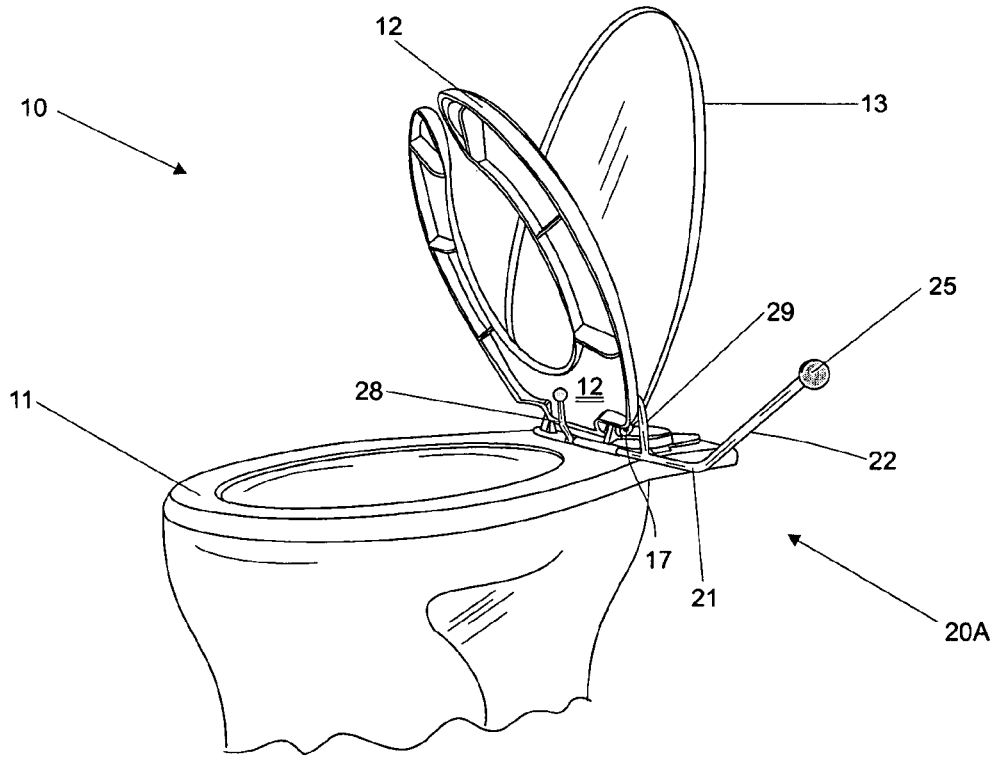
Figure 13C:
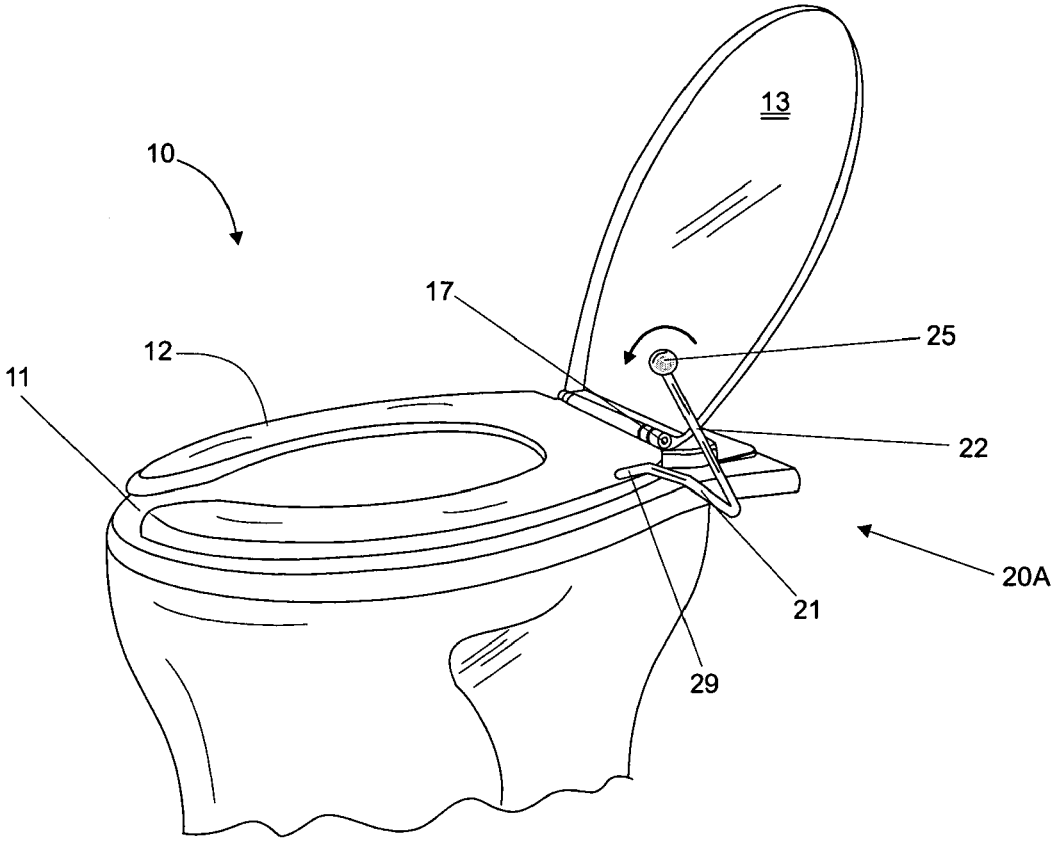

Reference is jointly made now to FIGS. 13A to 13C in order to explain how the device 20A acts in toilet 10. In particular, when the seat 12 and cover 13 are in horizontal position on the rim 11 of toilet 10 and a user rotates the lever 22 to the back of toilet 10 from an initial position, as shown in FIG. 13A, the upwards driving branch 28, by being in contact with the lower wall of seat 12, raises it along with cover 13 to a vertical position by rotating seat 12 on the hinge bolt 17 (FIG. 13B). Then, by moving the lever 22 to the front of toilet 10 to bring it to its initial position, the lever 22 moves the rotation axis 21, whose downwards driving branch 29, by being in contact with the upper wall of seat 12, lowers the seat and places it on the rim 11 of toilet 10 (FIG. 13C). Once again, the user only has to take the device 20A by handle 25.

The alternative embodiment that has been depicted and illustrated in FIGS. 6 to 13C is particularly useful for seats having a flat lower wall or those seats in which the owner does not wish to replace pieces, as in the preferred embodiment of FIGS. 1 to 5C, where the hinge bolt is replaced with rotation axis 21.

To sum up, the device of the present invention does not interfere with the toilet basic design or performance, since most of it is hidden under the seat and, for toilets including a cover, the device allows to raise it along with the seat.

It may be seen that the device to raise and lower a toilet seat of the present invention in any of the depicted embodiments has been created to avoid bothering users by making them raising a soiled toilet cover or seat. The device needs minimal room, since it is installed in parts, bores, or surfaces present in any type of toilet, such as the holes that are formed between the seat, cover, and hinge supports, or it is installed between the hinge supports and the rim of any toilet.

It will be apparent to those skilled in the art that the embodiments of the device to raise and lower a toilet seat of the present invention that have been previously depicted and illustrated in the appended drawings are solely illustrative and non-limitative of the present invention, since numerous changes may be made to their details without departing from the scope of the invention, as may be the rotation axis length, lever length, manufacturing materials, path of the upwards and downwards driving branches. Thus, the present invention must not be considered as limited, except for what is indicated by the prior art and the appended claims.

The invention claimed is:

1. A device to raise and lower a toilet seat, the seat being hingedly mounted to the toilet by two hinge supports and having a lower wall; the toilet optionally including a cover for the seat; wherein the seat and each hinge support are provided with holes that line up to create conduits for hinge bolts; the device comprising:

a) a rotation axis located under the lower wall of the seat, the rotation axis having two ends and a portion running between the hinge supports, said rotation axis being received in conduits for hinge bolts in order to be freely housed therein;

b) means for securing the rotation axis under the seat, the securing means being inserted through the seat until reaching and being fixed to the portion of said rotation axis running between the hinge supports;

c) a housing located around the portion of such rotation axis that is between the hinge supports, and d) a lever attached to one end of said rotation axis permitting a user to rotate the axis; which will cause the seat and the seat cover to be totated wherein when said lever moves said rotation axis inside the conduits for the hinge bolts, raising the seat to a vertical position, along with the cover; and thereafter, by moving said lever toward the front of the toilet to bring the lever to the initial position, the lever moves said rotation axis and lowers the seat on to the toilet.

2. The device to raise and lower a toilet seat of claim 1, wherein the securing means are selected from the group consisting of screws, bolts, coach screws, pins and rivets.

3. The device to raise and lower a toilet seat of claim 2, wherein the seat has a rear wall and the securing means are a screw that is inserted through the rear wall of the seat and is housed in the rotation axis.

4. The device to raise and lower a toilet seat of claim 1, wherein the length of the rotation axis is such that one of its ends is level with one of the hinge supports while the other end, to which the lever is attached, extends beyond the vertical plane of the toilet.

5. The device to raise and lower a toilet seat of claim 4, wherein the rotation axis has a length from 10 to 45 centimeters.

6. The device to raise and lower a toilet seat of claim 1, wherein the lever is attached to the rotation axis in a perpendicular relationship.

7. The device to raise and lower a toilet seat of claim 1, wherein the lever has a length from 10 to 40 centimeters.

8. The device to raise and lower a toilet seat of claim 1, wherein, when seen laterally and with the seat located on the toilet, the lever is located at an angle $\alpha$ ranging from 10° to 180° with respect to the horizontal plane of the toilet.

9. The device to raise and lower a toilet seat of claim 1, wherein the lever includes a handle in order to allow the device to be activated.

* * * * *